US010526839B2

(12) United States Patent
Kling

(10) Patent No.: US 10,526,839 B2
(45) Date of Patent: Jan. 7, 2020

(54) METHOD OF INSTALLING AN ADJUSTABLE CORNER PAD

(71) Applicant: Masonite Corporation, Tampa, FL (US)

(72) Inventor: William W. Kling, Lombard, IL (US)

(73) Assignee: Masonite Corporation, Tampa, FL (US)

( * ) Notice: Subject to any disclaimer, the term of this patent is extended or adjusted under 35 U.S.C. 154(b) by 200 days.

(21) Appl. No.: 15/418,252

(22) Filed: Jan. 27, 2017

(65) Prior Publication Data

US 2017/0218690 A1 Aug. 3, 2017

Related U.S. Application Data

(60) Provisional application No. 62/288,541, filed on Jan. 29, 2016.

(51) Int. Cl.
*E06B 7/23* (2006.01)
*E06B 3/96* (2006.01)

(52) U.S. Cl.
CPC ..... *E06B 7/2312* (2013.01); *E06B 3/96* (2013.01); *E06B 7/23* (2013.01)

(58) Field of Classification Search
CPC ..... E06B 7/2312; E06B 7/2314; E06B 3/96; E06B 7/23
See application file for complete search history.

(56) References Cited

U.S. PATENT DOCUMENTS 3,238,573 A 3/1966 Pease, Jr.
3,448,543 A 6/1969 Multer
3,952,455 A 4/1976 McAlarney
5,117,587 A 6/1992 Doan
5,577,349 A * 11/1996 Rissone ..... E06B 7/16 49/306
6,219,971 B1 4/2001 Headrick
8,127,500 B2 * 3/2012 Meeks ..... E06B 7/14 49/476.1
8,240,090 B2 * 8/2012 Meeks ..... E06B 7/2316 49/475.1
8,555,551 B2 * 10/2013 Meeks ..... E06B 7/2316 49/475.1
9,428,954 B1 * 8/2016 Jaskiewicz ..... E06B 7/2312
(Continued)

FOREIGN PATENT DOCUMENTS

DE 8421931 U1 11/1985
DE 202006000590 U1 5/2006
(Continued)

OTHER PUBLICATIONS

Corresponding PCT/US2017/015400 ISR, dated Apr. 5, 2017.

*Primary Examiner* — Gregory J Strimbu
(74) *Attorney, Agent, or Firm* — Berenato & White, LLC

(57) ABSTRACT

A sealing pad is configured to be adjustably mounted between the perimeter of a door and a surrounding doorjamb. The sealing pad is adjustably mounted to a bottom corner of the doorjamb. The sealing pad has a base, an inside lobe closest to an inside edge of the sealing pad, an outer lobe farthest away from the inside edge, and a middle lobe between the inside and outer lobes. The base contains a tail at the inside edge opposing and extending away from the outside lobe.

12 Claims, 4 Drawing Sheets

(56) References Cited

U.S. PATENT DOCUMENTS

| | | | | |
|---|---|---|---|---|
| 2002/0035810 | A1* | 3/2002 | Bennett | E06B 7/14 52/287.1 |
| 2007/0227076 | A1* | 10/2007 | Braun | E06B 7/14 49/505 |
| 2008/0010904 | A1* | 1/2008 | Meeks | E06B 7/2316 49/484.1 |
| 2009/0084041 | A1* | 4/2009 | Foster | E06B 7/23 49/479.1 |
| 2013/0199100 | A1 | 8/2013 | Van Camp et al. | |
| 2016/0243973 | A1* | 8/2016 | Goode | B60P 3/34 |
| 2017/0081908 | A1* | 3/2017 | Mitchell | E06B 7/18 |
| 2018/0163459 | A1* | 6/2018 | Mathieu | E06B 7/14 |

FOREIGN PATENT DOCUMENTS

| | | | |
|---|---|---|---|
| DE | 202013102160 | U1 | 8/2013 |
| DE | 102012111005 | A1 | 5/2014 |
| FR | 2121885 | A3 | 8/1972 |
| GB | 2195135 | A | 3/1988 |
| JP | 2001-107661 | A | 4/2001 |

* cited by examiner

METHOD OF INSTALLING AN ADJUSTABLE CORNER PAD

CROSS-REFERENCE TO RELATED APPLICATIONS AND CLAIM TO PRIORITY

This application claims priority to U.S. Provisional Patent Application No. 62/288,541, filed Jan. 29, 2016, which is incorporated herein by reference.

FIELD OF THE INVENTION

The present invention relates to sealing structures between the perimeter of a door and a surrounding structure such as a doorjamb. In particular, the present invention relates to a sealing pad that is adjustably mounted to a bottom corner of a doorjamb.

BACKGROUND

In many building structures it is highly desirable to provide effective sealing action to prevent or limit contact between the bottom of a doorjamb with insects or moisture. Typically, a relatively compressible fibrous material or plastic or rubber material has been widely employed for this purpose, e.g. by applying the material to the bottom of the doorjamb, such as with an adhesive. This method, however, does not allow the sealing material (corner seal) to be adjusted after it is applied to the doorjamb. Adjustability of the sealing material may be necessary for several reasons. For example, many door jambs are installed unfinished; i.e., unpainted. To be able to paint the jambs, the sealing material is usually removed by the painter, but the adhesive sealing material cannot be reinstalled on the door jamb after painting is complete. Also, removal of an adhesively attached corner seal may cause the seal to become damaged during removal, possibly requiring a new seal Further, many door sill assemblies have an adjustable threshold cap, so that overtime as the house settles and the flexible sweep on the bottom of the door wears, the threshold cap may be adjusted to maintain a proper seal. The method of using adhesive to affix the corner seal does not allow it to be moved and adjusted as the threshold cap is adjusted, resulting in the corner seal being improperly positioned after adjustment of the threshold cap.

Therefore, there remains a need for a corner seal whose position on the doorjamb is adjustable after it is applied to the doorjamb and/or after the door has been permanently secured or removed and reinstalled.

SUMMARY OF THE INVENTION

An object of the present invention is to provide a sealing pad that is applicable to the bottom of a doorjamb to effectively seal it from insects and/or moisture. The sealing pad contains a base and at least three lobes formed on top of the base, an inside lobe closest to an inside edge of the sealing pad, an outer lobe farthest away from the inside edge, and a middle lobe in between the inside and outer lobes. Preferably, the thickness of the sealing pad increases from the inside lobe to the middle lobe to accommodate the swinging arc of the door, so that as the door swings to a close position, the leading edge of the door does not catch and stop or tear the sealing pad. The base contains a tail, preferably a barbed tail, at the inside edge opposing and extending away from the outside lobe.

Another object of the present invention is to provide a method for installing the sealing pad. The method involves inserting the tail into a channel in the door jamb and tucking the outer lobe under the adjacent weather strip. Because adhesive is not used to affix the sealing pad to the door jamb, the position of the sealing pad may be adjusted by sliding it along the channel and the weather strip.

Other aspects of the invention, including apparatus, devices, kits, processes, and the like which constitute part of the invention, will become more apparent upon reading the following detailed description of the exemplary embodiments.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 5A is a perspective view of an embodiment the sealing pad;

FIG. 5B is a perspective view of another embodiment the sealing pad;

FIG. 6 is a perspective view of the bottom of an entryway opening with the door mounted and the weather strip removed; and FIG. 7 is a perspective view of the bottom of an entryway opening with the door mounted on the opposing vertical jamb and the weather strip removed.

DETAILED DESCRIPTION

Figure 1:
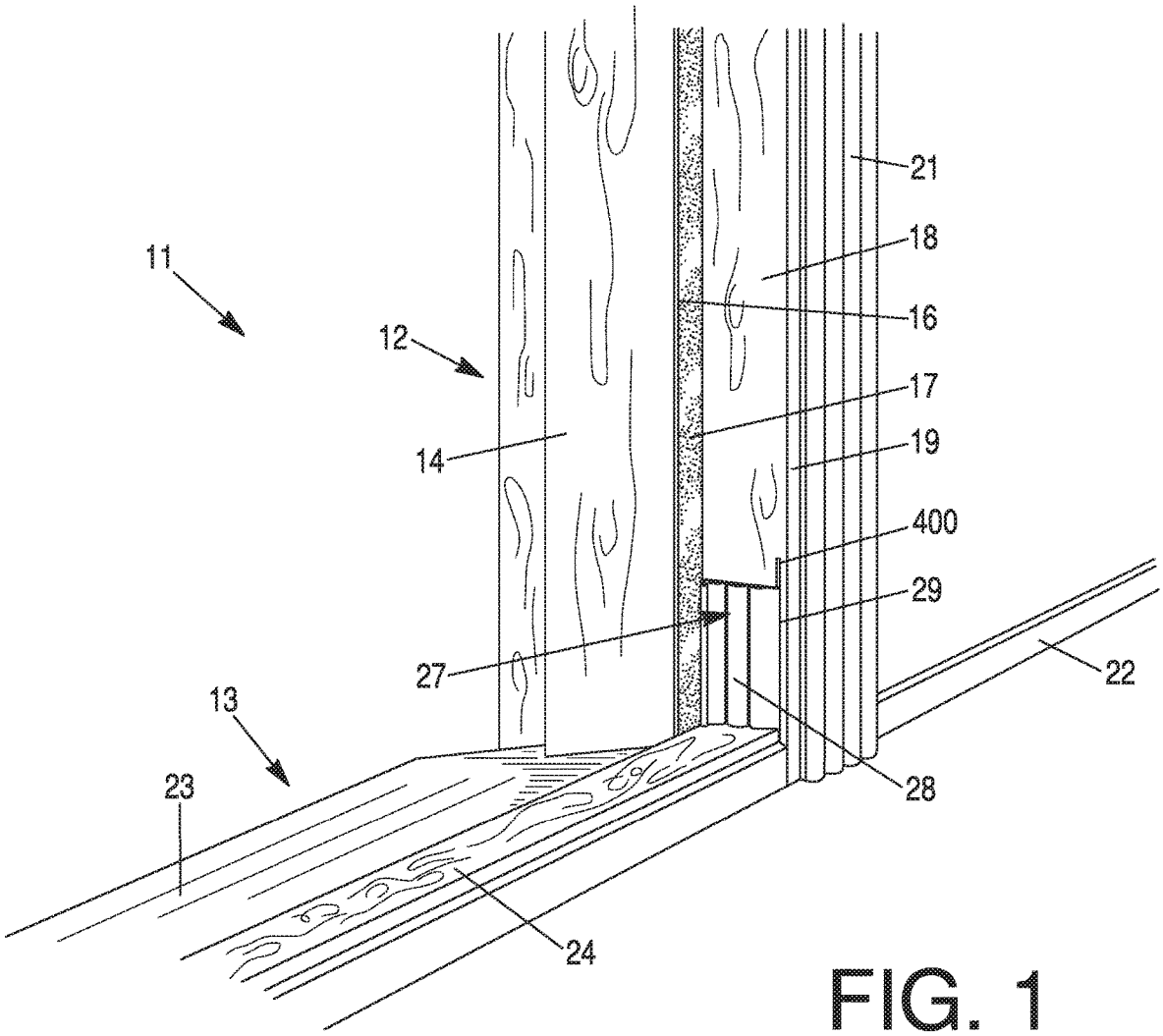
FIG. 1 is a perspective view of the bottom corner of a door jamb and threshold assembly.

Referring now in more detail to the drawings, in which like numerals refer to like parts throughout the several views, FIGS. 1, 2, 6, and 7 illustrate a door jamb and threshold assembly 11 that embody principles of this invention in a preferred form. The door jamb and threshold assembly 11 comprises a vertical side jamb 12 and a horizontal threshold and sill assembly 13 that is secured to the bottom of vertical side jamb 12. The threshold and sill assembly 13 preferably has a downwardly sloped outside sill 23 for the drainage of water and a threshold cap 24 that underlies a closed door of the entryway framed by the door jamb and threshold assembly 11. It will be understood that a second, opposing vertical side jamb (not shown) is spaced from the jamb 12 on the other side of the entryway to form, along with the head jamb, the entryway opening. A door 600 may be mounted on the vertical side jamb 12 by hinges 602, as shown in FIG. 6, or on the opposing vertical side jamb, as shown in FIG. 7.

The vertical side jamb 12, which can be milled of wood, formed of extruded plastic, or be fabricated from a combination of materials, is configured to define a vertical support member 14 that forms a raised stop 16 with respect to an inset surface 18 of the vertical side jamb 12. The vertical side jamb 12 has an inside edge 19 that may be in contact with a decorative casing 21, such as a brickmold. In a typical installation, baseboard 22 may abut the bottom of the decorative casing 21.

A weather strip 17 (shown in FIGS. 1-2), preferably made of a polymeric material, is mounted to the vertical side jamb 12 and extends around the inside periphery thereof along the raised stop 16. The weather strip 17 extends upwardly from the door jamb and threshold assembly 11 in front of the threshold cap 24 and extends around the perimeter of the entryway opening in which the door 600 pivots. The weather strip 17 may be a flexible foam or rubberized material that becomes captured and compressed between a closed door and the stop 16 to form a weather seal around the periphery of the door.

Figure 3:
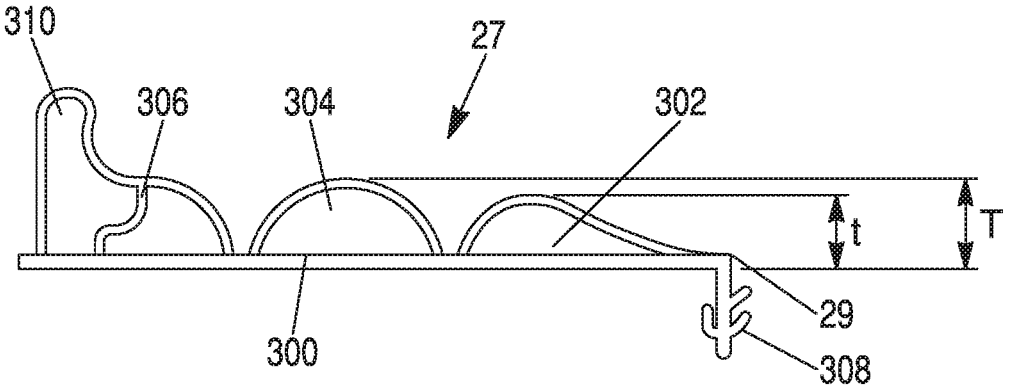
FIG. 3 is a cross-sectional view of the sealing pad.

A sealing pad 27, configured according to the principles of this invention, is secured to the inset surface 18 of the vertical side jamb 12 at the bottom end thereof where the vertical side jamb meets the threshold cap 24. The sealing pad 27, described in greater detail below and as illustrated in FIG. 3, has a generally tapered body with an exposed surface 28 and an inside edge 29. The sealing pad 27 is formed with a raised portion 310 that extends behind the weather strip 17 to reinforce the weather strip from its underside and provide a watertight seal. The sealing pad 27 may be applied at both of the bottom corners, as shown in FIG. 6, of the entryway opening to provide a seal at both locations, although it may be applied to only one corner if desired.

Figure 4:
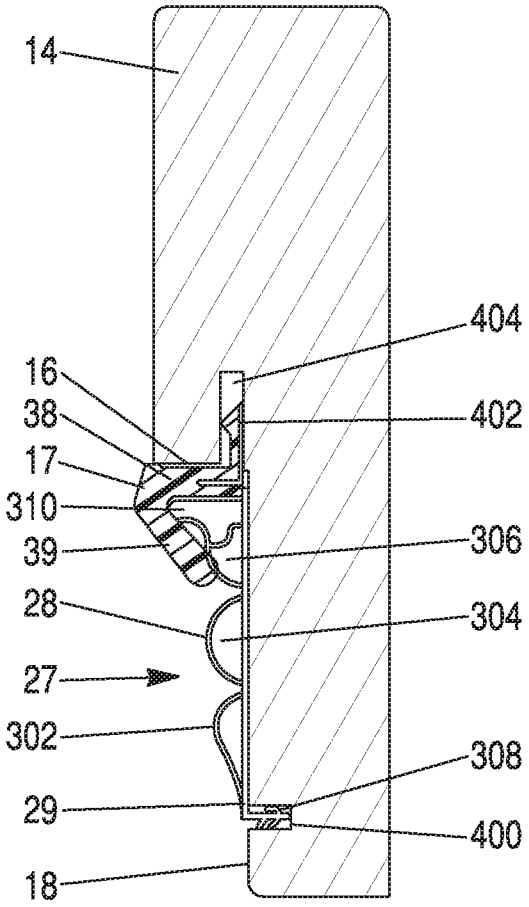
FIG. 4 is a cross-sectional view of the assembly of FIG. 1 taken through the sealing pad.

FIGS. 3 and 4 illustrates the configuration and function of the sealing pad 27 in greater detail. In an exemplary embodiment as best shown in FIG. 3, the sealing pad 27 contains a base 300 and at least three lobes formed on the base 300, including an inside lobe 302 closest to the inside edge 29, an outer lobe 306 farthest away from the inside edge, and a middle lobe 304 between the inside and outer lobes 302, 306. The base 300, preferably rectangular in shape, contains a barbed tail 308 extending at an angle, preferably a right angle, from the base 300, and opposing and extending away from the inside lobe 302. Preferably, the tail 308 forms approximately a right angle with the base 300 and has a plurality of axially spaced barbs extending therefrom which are resiliently deflectable to provide frictional engagement when the sealing pad 27 is positioned in the vertical side jamb 12. The tail 308 may extend the full length of the base 300, as shown in FIG. 5A, or may extend only portion of the length of the base 300, as shown in FIG. 5B. As used herein, the "length" of the tail 308 refers to the distance of the tail that extends along the base. Preferably, the thickness of the sealing pad 27 increases between the inside lobe 302 and middle lobe 304, such that the thickness t of the inside lobe 302 is less than the thickness T of the middle lobe 304. The thickness increase is accommodates the swinging arc of the door, so that as the door swings to a closed position, the leading edge of the door does not catch and stop or tear the sealing pad 27. Moreover, the thickness of the middle lobe 304 and the outer lobe 306 are configured to seal against the edge of the door, when the door is closed. Typically, a margin between the door and the door jamb is about 0.09-0.2 inches. The middle lobe 304 and the interior portion of the outer lobe 306 may be the same thickness to give two sealing points on the edge of the door. The outer lobe 306 contains a raised portion 310 that is configured to fit behind the weather strip 17 to provide a continuous sealing surface, as best shown in FIG. 4.

The sealing pad 27 may be formed from one or more flexible polymeric materials, e.g., by 3-D printing, extrusion, or injection molding. In one embodiment, the sealing pad 27 may be formed as a unitary piece. In another embodiment, the lobes 302, 304, 306 and the base may be formed separately and subsequently assembled, e.g. by adhesive, to form the sealing pad 27. The lobes 302, 304, 306 may be solid, hollow, or filled with a foam material. The material forming the base 300 and the lobes 302, 304, 306 may be the same or different. The materials may be selected, e.g., to provide sufficient rigidity to the base 300 and the tail 308 while allowing the lobes 302, 304, 306 to remain flexible. The tail 308 may be formed from the same material as the base 300 or a combination of the base material and the flexible lobe material. The polymeric material may be, but is not limited to, a thermoplastic elastomer, natural rubber, synthetic rubber, or combinations thereof.

Figure 2:
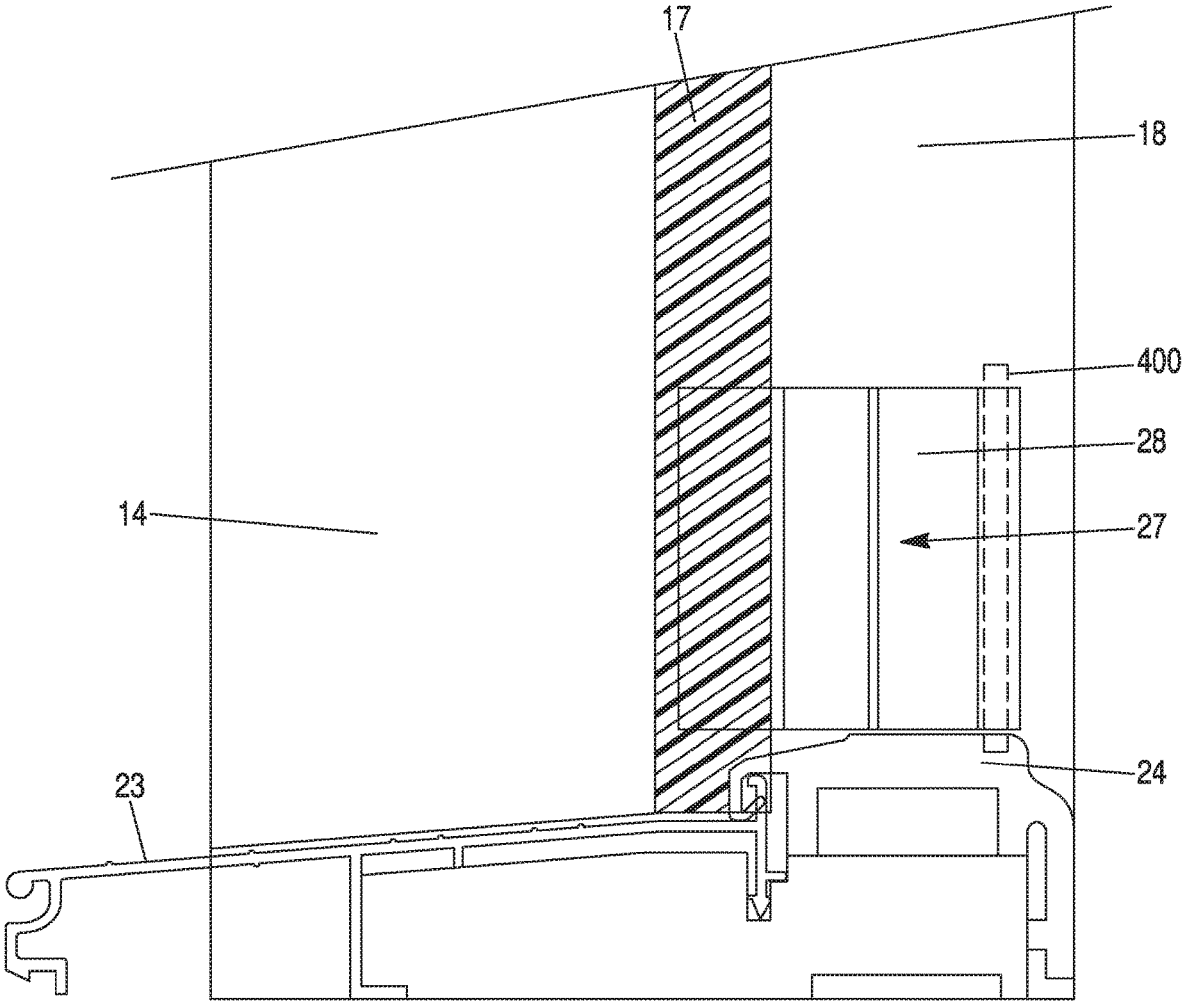
FIG. 2 is a side view partially in section of the bottom corner of a door jamb and threshold assembly of FIG. 1.

As illustrated in FIGS. 1, 2, and 4, the sealing pad 27 is to be fixed to the inset face 18 of the vertical side jamb assembly 12. Unlike prior art sealing pads which fix their pads to the inset face 18 with adhesive, the sealing pad 27 of the present invention requires no adhesive to fix the sealing pad 27 to the inset face 18. In an exemplary embodiment, as best illustrate in FIGS. 1 and 4, the sealing pad 27 is fixed to the inset face of the vertical side jamb assembly 12 by inserting the tail 308 into a channel 400 carved, milled or otherwise formed into the inset face 18 of the door jamb assembly 12 and by locating the outer lobe 306, particularly the raised portion 310 of the outer lobe 306, under the weather strip 17. The channel 400 preferably has a length that is longer than the length of the tail 308 along the inside edge 29 of the sealing pad 27, such that the position of the sealing pad 27 on the inset face 18 may be adjusted by sliding the pad long the length of the channel 400 and the weather strip 17. Further, the width of the channel 400 should be sufficiently narrow to retain the tail 308 in the channel 400 without allowing the tail 308 to pull away. The barbs on the tail 308 allow the tail to be frictionally retained in the channel 400. Preferably, the barbs extend from tail 308 a distance that is greater than the width of channel 400. The outer lobe 306 or a portion thereof is configured to interlock with the weather strip 17, and to allow the sealing pad 27 to slide on the inset face 18 for adjusting the position of the sealing pad 27. Preferably, the outer lobe 306 is preferably shaped and positioned to be disposed between a fixed leg 38 and a flexible leg 39 of the weather strip 17. Preferably, the raised portion 310 of the outer lobe 306 is shaped to conform to the angle that is formed by the fixed and flexible legs 38, 39 of the weather strip 17. In this way, the weather strip 17 may be reinforced and stiffened by the outer lobe 306 at the bottom corners of the entryway. As known in the art, the weather strip 17 may be retained on the vertical side jamb assembly 12 by inserting its mounting leg 402 in a groove 404 formed at the junction of the stop 16 and the inset face 18. The outer lobe 306 may also be configured to be used with weather strips 17 having profiles different from the one shown in FIG. 4.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A method for installing a sealing pad comprising the steps of a) providing the sealing pad having i) a base having an inside end and an outside end, ii) an inside lobe, a middle lobe, and an outer lobe positioned on the base, wherein the inside lobe is adjacent to the inside end, the outer lobe is adjacent to the outside end, and the middle lobe is located between the inside and outer lobes, and iii) a tail extending at an angle from the inside end of the base away from the inside lobe;

b) forming a channel in a doorjamb;

c) inserting the tail into the channel;

d) interlocking a weather strip with the outer lobe; and e) adjusting a position of the sealing pad by sliding the sealing pad along the door jamb with the tail in the channel to maintain a seal with respect to a threshold cap.

2. The method of claim 1, wherein the sealing pad is generally tapered from the outer lobe to the inside lobe.

3. The method of claim 1, wherein the outer lobe contains a raised portion that is thicker than a thickness of the middle lobe.

4. The method of claim 1, wherein the base is rectangular in shape.

5. The method of claim 1, wherein the tail comprises a plurality of resilient barbs.

6. The method of claim 5, wherein the resilient barbs frictionally hold the tail in the channel.

7. The method of claim 1, wherein the angle is a right angle.

8. The method of claim 1, wherein the base, lobes, and tail each comprises a flexible polymeric material.

9. The method of claim 1, wherein each of the lobes is solid or hollow.

10. The method of claim 1, wherein the lobes are filled with foam.

11. The method of claim 1, wherein the lobes are configured to seal against a door.

12. The method of claim 1, wherein the channel has a length longer than a length of the tail.

* * * * *